US009162465B1

(12) United States Patent
Tamarez Gomez et al.

(10) Patent No.: US 9,162,465 B1
(45) Date of Patent: Oct. 20, 2015

(54) METHOD AND APPARATUS TO CLEAN PRINTHEADS IN AN INKJET PRINTER

(71) Applicant: Xerox Corporation, Norwalk, CT (US)

(72) Inventors: Frank B. Tamarez Gomez, Webster, NY (US); Matthew R. McLaughlin, Rochester, NY (US); Mark A. Adiletta, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/672,740

(22) Filed: Mar. 30, 2015

(51) Int. Cl.
*B41J 2/165* (2006.01)
*B41J 2/17* (2006.01)

(52) U.S. Cl.
CPC ..... *B41J 2/1721* (2013.01)

(58) Field of Classification Search
CPC ..... B41J 2/1721; B41J 2002/1728; B41J 2002/1735; B41J 2002/1742; B41J 2/16523; B41J 2/16538; B41J 2/16547; B41J 2/16544; B41J 2/16535
See application file for complete search history.

(56) References Cited

U.S. PATENT DOCUMENTS

| | | | | |
|---|---|---|---|---|
| 6,866,361 | B2 | 3/2005 | Kuki et al. | |
| 7,909,430 | B2 | 3/2011 | Sakaida | |
| 2012/0194609 | A1* | 8/2012 | Leighton et al. | 347/33 |

* cited by examiner

*Primary Examiner* — Lisa M Solomon
(74) *Attorney, Agent, or Firm* — Maginot Moore & Beck LLP

(57) ABSTRACT

An inkjet printer is configured to purge printheads in the printer and clean the purged ink from the printheads. The inkjet printer includes a purge tray configured with a wiper to remove a substantial portion of the purged ink from the faces of the printheads without contacting the printheads. A wiper module rotates wipers through a reservoir of cleaning fluid prior to contacting the printheads to facilitate removal of the remaining purged ink from the printheads as the printheads move past the wiper module to return to a printing position.

15 Claims, 8 Drawing Sheets

METHOD AND APPARATUS TO CLEAN PRINTHEADS IN AN INKJET PRINTER

TECHNICAL FIELD

This disclosure relates generally to inkjet printers, and more particularly to systems used in inkjet printers to remove purged ink from printheads.

BACKGROUND

In general, inkjet printers include at least one printhead that ejects drops of liquid ink onto a surface of an image receiving member. In an indirect or offset printer, the inkjets eject ink onto the surface of a rotating image receiving member, such as a rotating metal drum or endless belt, before the ink image is transferred to print media. In a direct printer, the inkjets eject ink directly onto print media, which may be in sheet or continuous web form.

In inkjet printers, the printheads are configured with an array of ejectors that are fluidly connected to an array of apertures in a face plate in a one-to-one correspondence. The ejectors are typically piezoelectric or thermal devices that are activated to eject one or more drops of ink from a chamber between the ejector and the aperture to which the ejector is connected. Sometimes, the viscosity of the ink, debris, or other issues can partially or completely block an aperture, the chamber, or the supply of ink to the chamber. To restore the ability of an ejector to eject ink drops through the aperture to which it is connected, printheads are purged. Purging refers to a pressure source being coupled to the pneumatic system within a printhead to urge ink through the chambers in the printheads and emit ink from the apertures of the printhead. This emitted ink is not expelled with sufficient pressure to escape the printhead, but rather remains on the face plate of the printhead.

To remove purged ink from the face plates of printheads, various systems have been developed that heat, wipe, or suction ink from the face plates. Some inks have special properties that make them especially difficult to remove from the face plates of printheads. For example, some printers include printheads that eject magnetic inks. These magnetic inks include solvents that dry quickly once exposed to ambient air and metal particles that can cling to the face plates. Improvements in systems that remove purged ink having special properties that make removal of the ink difficult are beneficial.

SUMMARY

A printer disclosed in this document includes a system that removes most any type of purged ink from printhead faces. The printer includes a plurality of printheads arranged to eject ink across a width of an image receiving surface in a cross-process direction as the image receiving surface passes the plurality of printheads in a process direction, the plurality of printheads being operatively connected to an actuator and the actuator being configured to move the plurality of printheads in the cross-process direction past the image receiving surface; a wiper module having a reservoir configured to hold a cleaning fluid, at least one wiper, and at least one actuator operatively connected to the at least one wiper, the at least one wiper being configured to rotate the at least one wiper into the cleaning fluid held within the reservoir and into a position in which the at least one wiper can contact the plurality of printheads after the plurality of printheads has past the image receiving surface; a plurality of caps, each cap being configured to align with a printhead in the plurality of printheads when the plurality of printheads is positioned opposite the plurality of caps, each cap being operatively connected to an actuator to enable each cap to be moved to cover a face of the printhead aligned with the cap to enable the printhead covered by each cap to be purged and to enable each cap to be retracted from the printhead covered by each cap; a receptacle having a volume and a wiper positioned across a width of the receptacle, the receptacle being operatively connected to an actuator to enable the receptacle to be moved in a direction opposite the process direction to move the wiper across the plurality of printheads when the plurality of printheads is positioned opposite the plurality of caps, the wiper being positioned to enable the wiper to remove a portion of ink purged from each printhead in the plurality of printheads that has been purged without contacting the face of each printhead; and a controller operatively connected to the actuator that is operatively connected to the plurality of printheads, the actuator that is operatively connected to the receptacle, the actuator that is operatively connected to the plurality of caps, and the at least one actuator that is operatively connected to the at least one wiper. The controller is configured to: operate the actuator operatively connected to the plurality of printheads to move the plurality of printheads from a position opposite the image receiving surface to the position opposite the plurality of caps; operate the actuator operatively connected to the plurality of caps to move the caps in the plurality of caps to cover the face of each printhead in the plurality of printheads and to move the caps in the plurality of caps away from the face of each printhead in the plurality of printheads in response to the printheads in the plurality of printheads being purged; operate the actuator operatively connected to the receptacle to move the receptacle between plurality of caps and the plurality of printheads to remove the portion of the ink purged from the plurality of printheads and enable the removed portion of the ink to fall within the receptacle; operate the actuator operatively connected to the at least one wiper to move the wiper from the position within the reservoir to a position that enables the at least one wiper to contact the printheads in the plurality of printheads; and operate the actuator operatively connected to the plurality of printheads to move the plurality of printheads past the wiper module to enable the at least one wiper to contact the faces of the printheads in the plurality of printheads as the plurality of printheads moves past the wiper module to remove ink from the faces of the printheads in the plurality of printheads and to return the plurality of printheads to a position opposite the image receiving surface.

A method of operating an inkjet printer enables most any type of purged ink to be removed from printheads faces. The method includes operating with a controller an actuator operatively connected to a plurality of printheads to move the plurality of printheads from a position opposite an image receiving surface to a position opposite a plurality of caps; operating with the controller an actuator operatively connected to the plurality of caps to move the caps in the plurality of caps to cover the face of each printhead in the plurality of printheads and to move the caps in the plurality of caps away from the face of each printhead in the plurality of printheads in response to the printheads in the plurality of printheads being purged; operating with the controller an actuator operatively connected to a receptacle to move the receptacle between the plurality of caps and the plurality of printheads to remove a portion of the ink purged from the plurality of printheads and enable the removed portion of the ink to fall within the receptacle; operating with the controller an actuator operatively connected to at least one wiper to move the at least one wiper from a position within a reservoir to a position that enables the at least one wiper to contact the printheads in the plurality of printheads; and operating with the controller an actuator operatively connected to the plurality of printheads to move the plurality of printheads past the at least one wiper to enable the at least one wiper to contact the faces of the printheads in the plurality of printheads as the plurality of printheads moves past the at least one wiper to remove ink from the faces of the printheads in the plurality of printheads and to return the plurality of printheads to a position opposite the image receiving surface.

DETAILED DESCRIPTION

Figure 1:
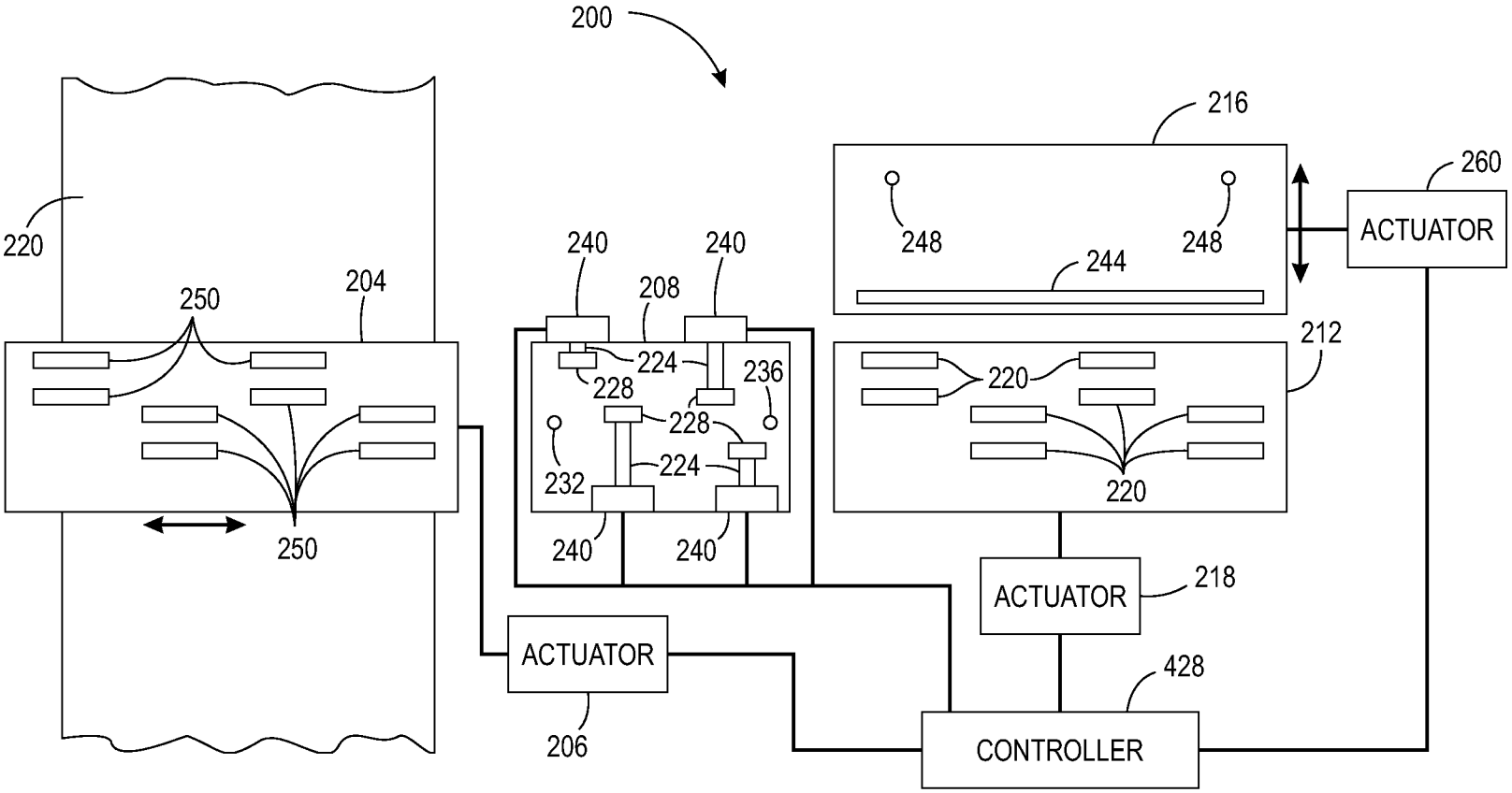
FIG. 1 is a block diagram of a system configured to remove most any type of ink purged from printheads in an inkjet printer.

For a general understanding of the environment for the system and method disclosed herein as well as the details for the system and method, reference is made to the drawings. In the drawings, like reference numerals have been used throughout to designate like elements.

As used herein the term "printer" refers to any device that is configured to produce images made with one or more colorants on print media. Common examples of printers include, but are not limited to, xerographic and inkjet printers. Various printer embodiments use one or more marking materials, such as ink or toner, to form printed images in various patterns. An "image receiving surface" in this document refers to any surface that receives a marking material, such as an imaging drum, imaging belt, or various print media including paper. As used herein, the term "marking material" refers to a substance deposited on a substrate to form a printed image on the substrate. The marking material can be ink, for example aqueous or phase change inks, xerographic developer or toner particles, or any other substance used for forming an image on a substrate. The term "substrate" refers to a print medium, such as paper, that holds printed images. In some embodiments, the printer is a digital printer. Digital printers enable an operator to design and modify image data to alter the image printed on the substrate easily using, for example, commercially available image editing software.

A continuous feed or "web" printer produces images on a continuous web print substrate such as paper. In some configurations, continuous feed printers receive image substrate material from large, heavy rolls of paper that move through the printer continuously instead of individually cut sheets. The paper rolls can typically be provided at a lower cost per printed page than pre-cut sheets. Each such roll provides an elongated supply of paper printing substrate in a defined width. Fan-fold or computer form web substrates may be used in some printers having feeders that engage sprocket holes in the edges of the substrate. After formation of the images on the media web, one or more cutting devices separate the web into individual sheets of various sizes. Some embodiments use continuous feed printing systems to print a large number of images in a timely and cost efficient manner. As used herein, the term "magnetic ink" refers to an ink that includes a suspension of magnetic particles in a liquid or phase-change medium. Some magnetic inks include a suspension of particles, such as iron oxide, in an aqueous or organic based solvent.

Figure 8:
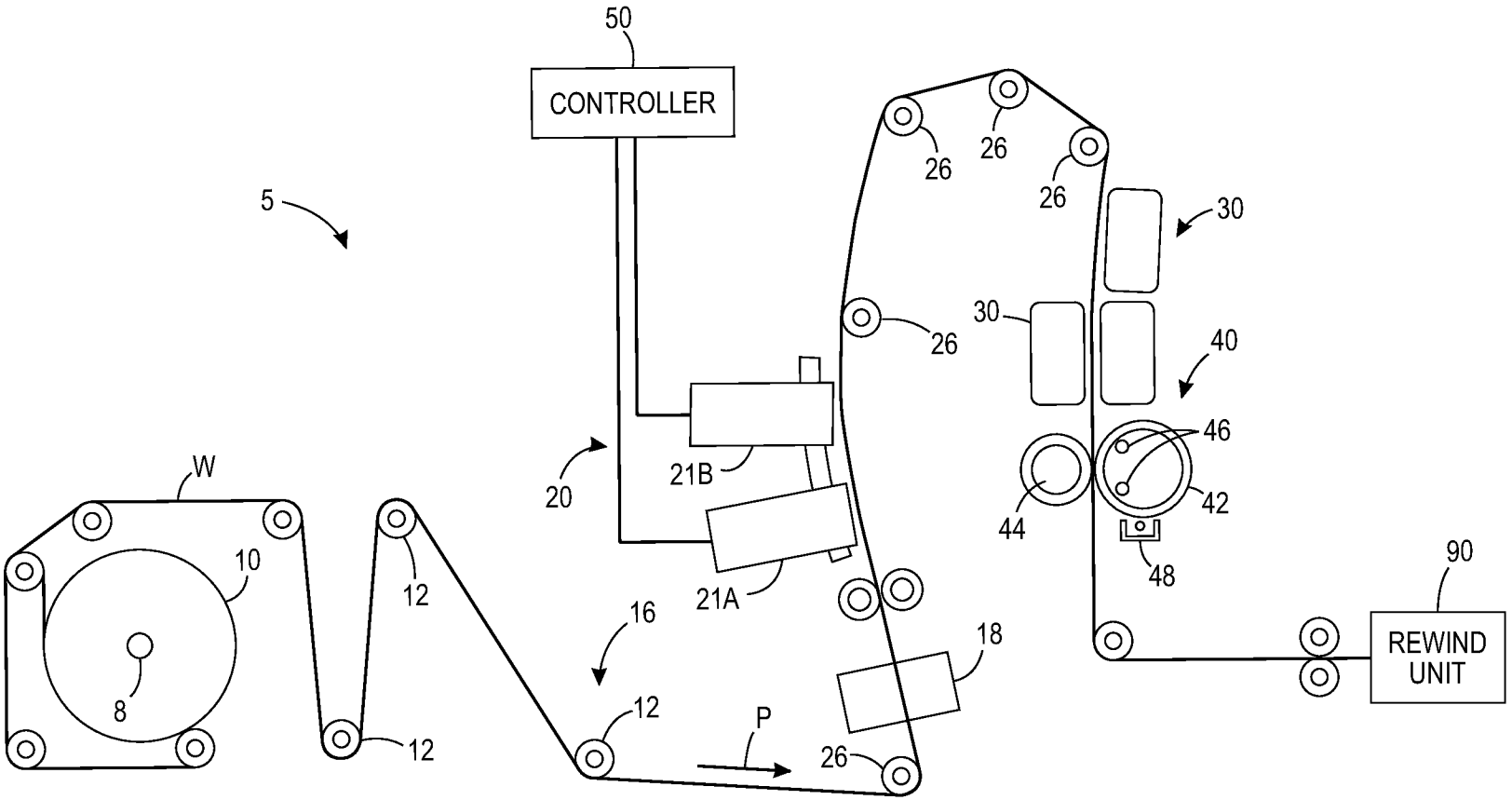
FIG. 8 is a diagram of a prior art printer that can be adapted to use the system of FIG. 1.

FIG. 8 is a simplified schematic view of the direct-to-sheet, continuous-media, aqueous inkjet printer 5, that is configured to print images with various aqueous inks. A media supply and handling system is configured to supply a long (i.e., substantially continuous) web of media W of "substrate" (paper, plastic, or other printable material) from a media source, such as spool of media 10 mounted on a web roller 8. One common type of substrate is uncoated paper. The uncoated paper includes a matrix of cellulose fibers. The uncoated paper is porous and can absorb liquids, including liquid inks, which are printed on the paper. The printer 5 includes a feed roller 8, media conditioner 16, printing station or print zone 20, and rewind unit 90. The media source 10 has a width that substantially covers the width of the rollers 12 and 26 over which the media travels through the printer. The rewind unit 90 is configured to wind the web onto a take-up roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a print zone 20 that includes a series of printhead units 21A and 21B. Each printhead unit effectively extends across the width of the media and is able to place ink directly (i.e., without use of an intermediate or offset member) onto the moving media. Each of the printhead units 21A and 21B includes a plurality of printheads positioned in a staggered arrangement in the cross-process direction over the media web 14. As is generally known, each of the printheads can eject a single color of ink, one for each of the inks typically used in the printer 5. As used herein, "liquid ink" refers to inks formed with water as a solvent and include, but are not limited to, ink emulsions, ink suspensions, ink solutions, or the like. In the configuration illustrated in FIG. 8, the printhead units 21A and 21B eject liquid ink onto the media web 14. These printhead units can include multiple printheads arranged in staggered arrays that eject different colors of liquid ink for multi-color printing. In the print zone 20, the media web 14 passes the printhead units 21A and 21B in the process direction P to receive liquid ink.

The controller 50 of the printer receives velocity data from encoders mounted proximate to rollers positioned on either side of the portion of the path opposite the printhead units 21A and 21B to compute the position of the web as the web moves past the printheads. The controller 50 uses these data to generate timing signals for actuating the inkjets in the printheads to enable the different colors ejected by the printheads in the printhead units to be ejected with a reliable degree of accuracy for registration of the non-magnetic ink patterns to form single or multi-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of printhead units and can print inks having a variety of different colors.

Following the print zone 20 along the media path, the media web moves over guide rollers 26 to one or more "mid-heaters" 30. A mid-heater 30 can use contact, radiant, conductive, and/or convective heat to control a temperature of the media and the ink on the media. The mid-heater 30 brings the ink placed on the media to a temperature suitable for desired properties when the ink on the media is sent through the spreader 40. Following the mid-heaters 30, a fixing assembly 40 is configured to apply heat, pressure, or both to the media to fix the images to the media. The fixing assembly 40 includes any suitable device or apparatus for fixing images to the media including heated or unheated pressure rollers, radiant heaters, heat lamps, and the like. In the embodiment of FIG. 8, the fixing assembly includes image-side roller 42 and pressure roller 44. These rollers apply a predetermined pressure, and in some implementations, heat, to the media web. Either roller can include heat elements, such as heating elements 46, to bring the web to a temperature in a suitable range for the type of liquid ink being used to form images on the web.

The fixing assembly 40 also includes a cleaning/oiling station 48 associated with the image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one embodiment, the mid-heater 30 and fixing assembly 40 can be combined into a single unit, with their respective functions occurring relative to the same portion of media simultaneously. In another embodiment the media is maintained at a high temperature as it is printed to enable spreading of the ink.

Following passage through the media path, the printed media can be wound onto a roller for removal from the system. A rewind unit 90 winds the printed media web onto a take-up roller for removal from the printer 5 and subsequent processing. Alternatively, the media can be directed to other processing stations that perform tasks such as cutting, binding, collating, and/or stapling the media or the like.

Operation and control of the various subsystems, components and functions of the printer 5 are performed with the aid of the controller 50. The controller 50 can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In order to both purge and clean ink from the printheads in the printhead units 21A and 21B, a purge and wipe system 200 has been developed. This system 200 is depicted in FIG. 1. The system includes a printhead assembly 204, a wiper assembly 208, a printhead seal assembly 212, a purge tray 216, and a controller 428. The printhead assembly 204 is an arrangement of a plurality of printheads that is located within a print unit 21A or 21B. The web 220 moves past the printhead assembly. The printheads 250 are configured in a staggered printhead array as provided in previously known printers. This staggered assembly enables printheads having a cross-process width of about 4.5 inches to print a 17.5 inch cross-process direction width of the web 220 at 600 dots per inch (dpi). An actuator 206 is operatively connected to the printhead assembly 204 to move the assembly bi-directionally as indicated by the arrows adjacent the assembly 204 in the figure.

The wiper assembly 204 includes four actuators 240, each of which is operatively connected to a rotatable cam 228 by a rotating shaft 224. The cams are configured with wipers as described below. The actuators are operated to rotate the wipers through a reservoir of cleaning fluid beneath the cams 228 and then to a position that enables each wiper to wipe the faces of two printheads in a single row of the printhead assembly 204. The removed ink falls into the reservoir, which has a slanted floor that enables the removed ink to slide along the floor to a drain 236. Cleaning fluid is provided to the reservoir through supply port 232. Printhead seal assembly 212 includes sealing caps, which are typically made of compliant material, such as silicone. These caps are operatively connected to an actuator 218 that lifts the caps into engagement with the faces of printheads when the printhead assembly 204 is moved to a position opposite the printhead seal assembly. Pressure is then applied to the internal reservoirs, manifolds and channels in the printheads to urge ink through the printheads and onto the faces of the printheads. The sealing caps are then lowered by the actuator 218 to enable actuator 260, which is operatively connected to the purge tray 216, to be operated by the controller 428 to move the purge tray 216 between the sealing cap assembly 212 and the printhead assembly 204. A wiper 244 is provided within the purge tray 216 to be close to, but not touch, the faces of the printheads 250 in the printhead assembly 204. When the assembly 204 is opposite the seal assembly 212, the wiper 244 in the tray 216 removes a substantial amount of ink remaining on the faces of the printhead after the purge. The floor of the purge tray 216 slants to the drains 248 to enable the removed purged ink to be collected in a waste receptacle, which is fluidly connected to the drains 248.

The system of FIG. 1 is operated in the following manner to perform a purge operation. The purge operation begins with the controller 428 operating the actuator 206 to move the printhead assembly past the wiper assembly 208 while the controller 428 operates the actuators 240 to rotate the cams to position the wipers within the cleaning fluid reservoir. The controller 428 stops the printhead assembly 204 when it is opposite the sealing cap assembly 212. After the controller 428 operates the actuator 218 to raise the caps 220 to seal the printhead faces, the ink is purged from the printheads. The controller 428 then operates the actuator 218 to lower the sealing caps and the controller operates actuator 260 to move the purge tray to the position between the sealing cap assembly 212 and the printhead assembly 204. As the purge tray moves to the position opposite the printhead assembly, the wiper 244 removes a substantial portion of the purged ink remaining on the printhead faces. The controller 428 operates the actuator 260 to return the purge tray to its original position and during this retraction, the wiper 244 again removes ink from the printhead faces. Once the tray 216 returns to its original position, the controller 428 operates the actuators 240 to rotate the cams 228 so the wipers are positioned in the return path of the printheads to the printing position. As the controller 428 operates the actuator 206 to return the printhead assembly 204 to the printing position, the printhead assembly moves past the wipers on the cams 228 and the wipers contact the faces of the printheads. The wiping action coupled with the cleaning fluid on the wipers removes the remaining purged ink from the printhead faces. When the printhead assembly reaches the printing position from which it started, the controller 428 stops the printhead assembly 204 and the purging operation is completed. The printhead assembly is now ready for printing.

Figure 2A:
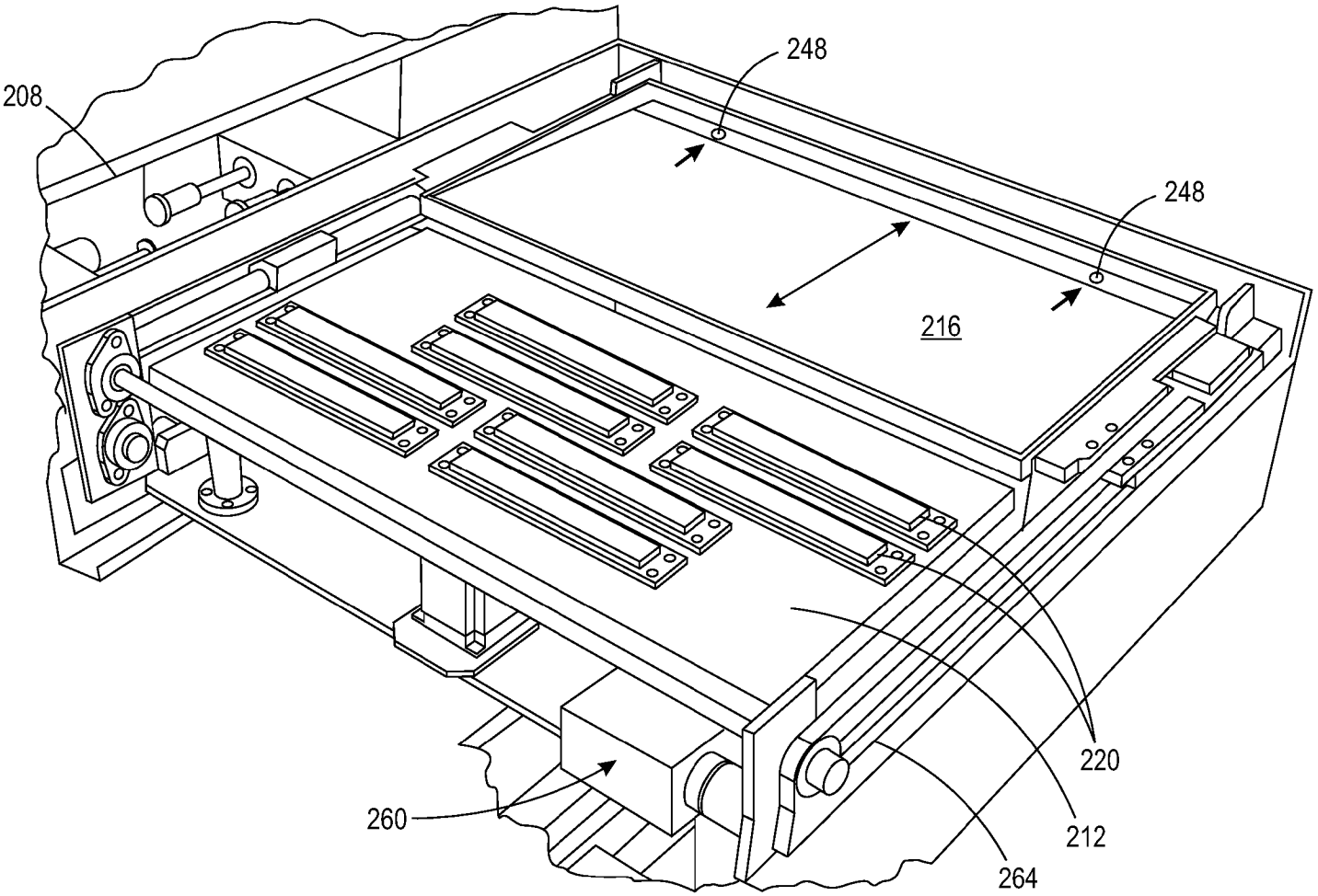
FIG. 2A is a depiction of a printhead sealing system and purge tray used in the system of FIG. 1.
Figure 2B:
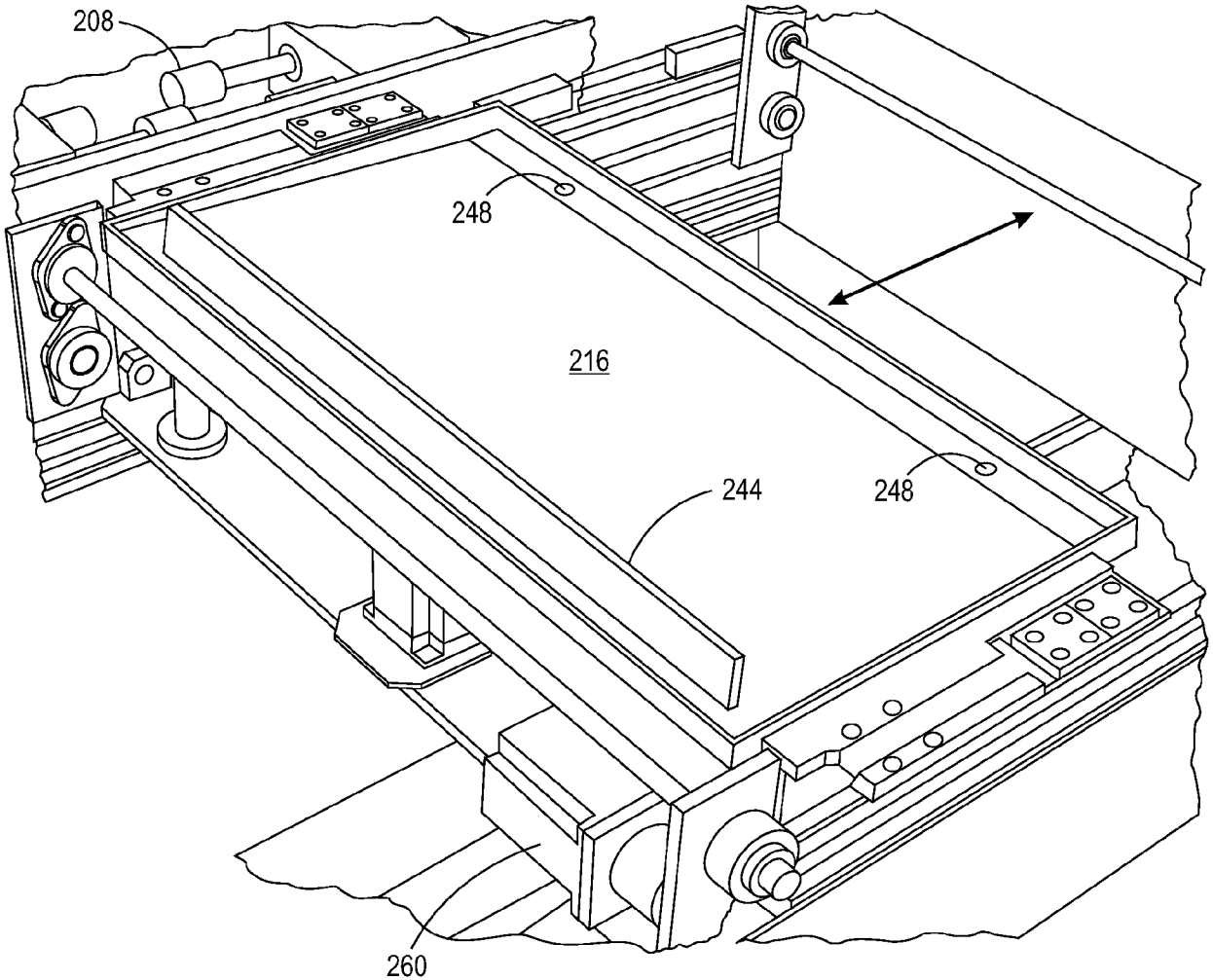
FIG. 2B is a depiction of the purge tray of FIG. 2A when it covers the printhead sealing system shown in FIG. 2A.
Figure 3:
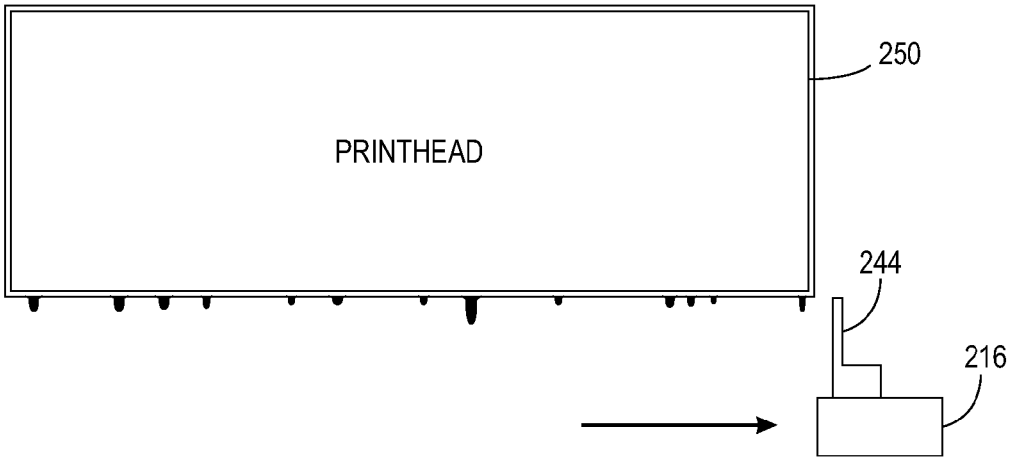
FIG. 3 is an illustration of a wiper in the purge tray of FIG. 2A wiping ink from a printhead face.

FIG. 2A shows details of the sealing cap assembly 212 and purge tray 216. The wiper assembly 208 is shown as being aligned with the sealing cap assembly 212. Eight sealing caps 220 are depicted in the sealing cap assembly 212 in a configuration that corresponds to the array of printheads in one of the print units 21A or 21B. The actuator 260 is operatively connected to a belt drive system 264 to move the purge tray between the position shown in FIG. 2A and the position shown in FIG. 2B. In FIG. 2B, the wiper 244 is not shown to facilitate the viewing of the tray. The tray 216 slopes from the side nearest the sealing cap assembly 212 down to the drains 248. In FIG. 2B, the purge tray 216 covers the sealing cap assembly 212. Thus, the movement of the tray 216 to the position shown in FIG. 2B and then back to the position in FIG. 2A enables the wiper 244 to remove a substantial amount of the purged ink from the faces of the printheads. As shown in FIG. 3, the wiper 244 does not touch the face of printhead 250 from which the purged ink extends. As the tray 216 moves in the direction of the arrow in FIG. 3, the wiper 244 removes the purged ink except for the ink immediately adjacent the printhead face. This ink is later removed by the wiper assembly 208.

Figure 4:
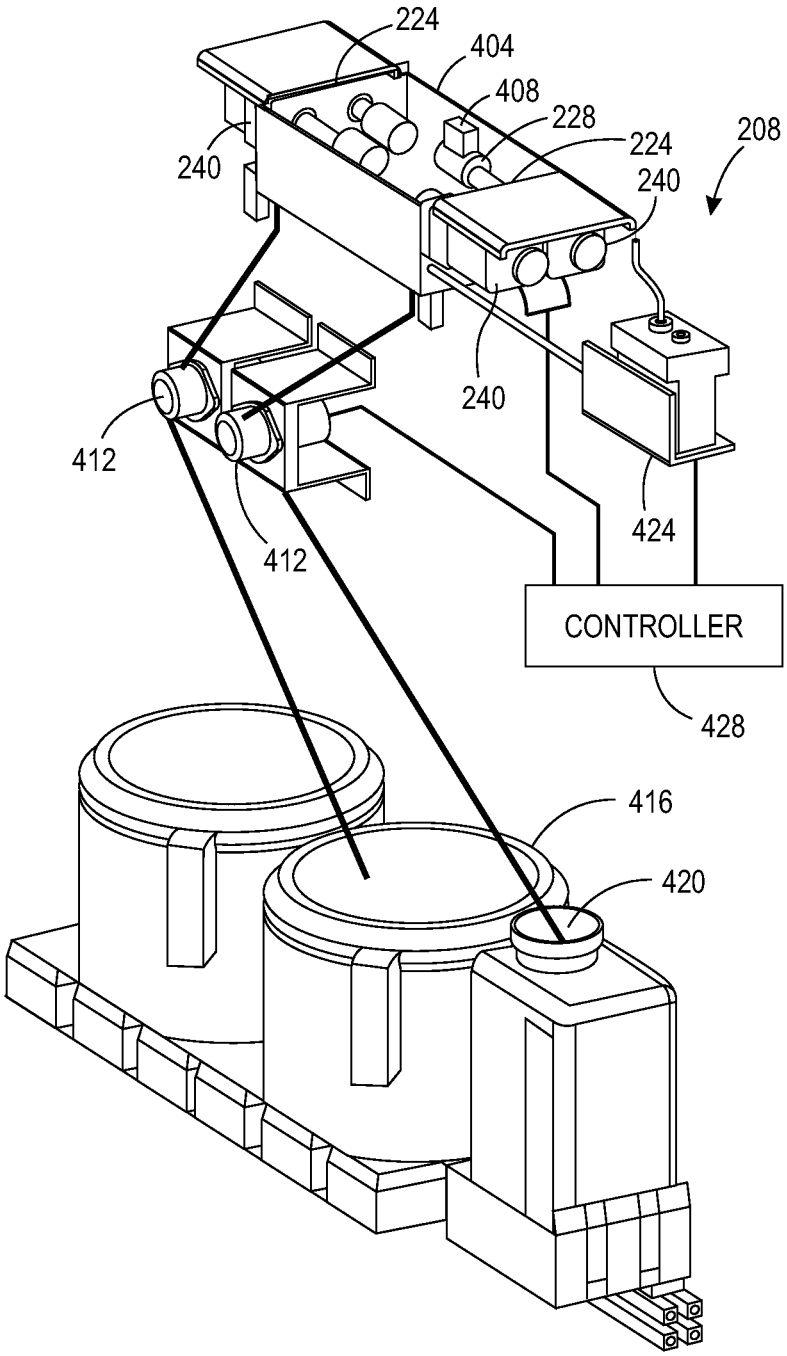
FIG. 4 is a schematic diagram of a wiper module of the system shown in FIG. 1.

The wiper module 208 is shown in greater detail in FIG. 4. The module 208 includes a container 404 that is fluidly connected to a cleaning fluid source 416 and a waste receptacle 420. In embodiments in which the wiper module is installed in printers using inks with properties that make purged ink difficult to remove from printhead faces, the container 404 contains fluid especially adapted to removing the ink. For example, the fluid in container 404 can be a fluid specifically designed for cleaning magnetic ink, such as the one sold by Diversify Nano Corporation of [city, state] and designated by part number [xxxxx]. A fluid level sensor 424 also monitors the cleaning fluid level in the container 404. In the assembly shown in FIG. 4, the container 404 is configured to hold a volume of cleaning fluid that is provided from cleaning fluid supply 416 through one of the peristaltic pumps 412. The controller 428 operates the peristaltic pump 412 in response to a signal from sensor 424 indicating the cleaning fluid level in the container 404 has reached a low level. Additionally, the controller 428 operates the other peristaltic pump 412 in response to the sensor 424 generating a signal that indicates the cleaning fluid level in the container 404 has reached an overfill level. Operation of that peristaltic pump 412 removes cleaning fluid from the reservoir in the container 404 and directs it to the waste receptacle 420. Although FIG. 4 shows the controller 428 being connected to the actuators 240 on one side of the container 404, it is also connected to the two actuators on the other side, but those connections are not shown to simplify the figure. Each actuator 240 is connected to one of the cams 228 by one of the shafts 224. The controller 428 operates the actuators to rotate the cams so the wipers 408 connected to a cam are positioned within the cleaning fluid in the container 404 when the printheads move over the wiper assembly 208 to reach the sealing cap assembly 212. The controller 428 also operates the actuators 240 to rotate the cams and position the wipers 244 for cleaning the printheads before the printheads are returned to the printing position.

Figure 5:
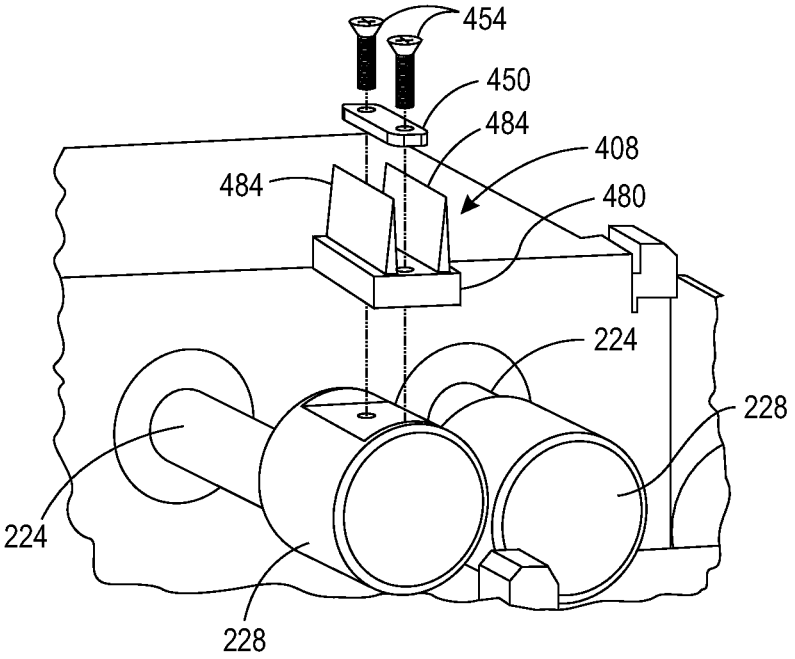
FIG. 5 illustrates details of wipers used in the wiper module of FIG. 4.

FIG. 5 shows a configuration of one of the wipers 408. The wiper 408 has a base 480 from which two wiper blades 484 extend. The base and wiper blades can be made from an elastomeric material, such as a hard rubber or silicone. A collar 450, which can be made of metal, fits within the area between the two wiper blades 484. The collar 450 includes two apertures that receive screws 454, which thread into threaded openings in the cam 224 to secure the wipers 484 to the cam 224. The metal collar stiffens the blades 484 to make them more resilient to the movement of the printhead faces on the wiper 408. Although the wiper 408 is shown as having two wiper blades 484, a single wiper blade or more wiper blades could be provided.

Figure 6:
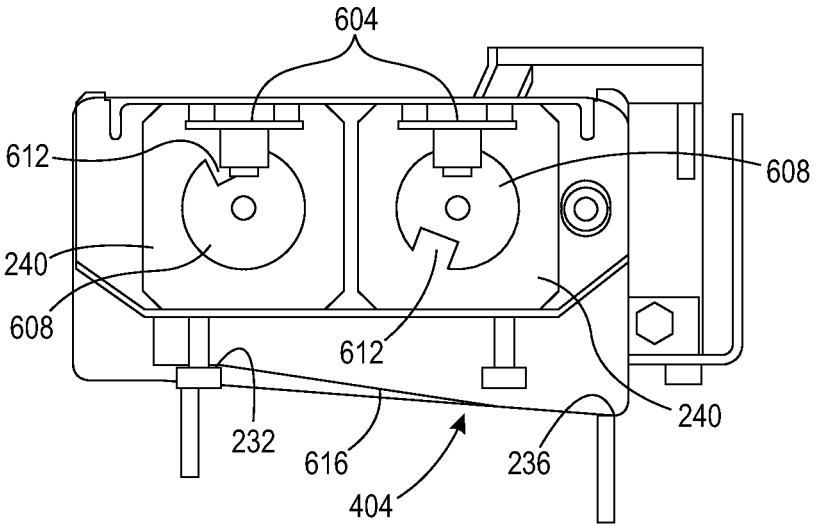
FIG. 6 is a side view of the actuators that rotate the wipers within the wiper module of FIG. 4.

An end view of the container 404 is shown in partial cutaway in FIG. 6. The container 404 is formed with a slanted floor 616. The port 232 is provided at the high side of the slope for the supply of cleaning fluid into the container and the drain 236 is provided at the low side for the removal of fluid with purged ink. The view in FIG. 6 also depicts the two actuators 240. Each actuator, which can be implemented with a stepper motor, has a wheel 608 that rotates with the shafts 224. The wheels 608 include a notch 612 and a sensor 604. The sensor 604 detects the presence of the notch 612 to detect when the wiper 408 is in position to wipe a printhead face. By counting a predetermined number of steps performed by the actuator, the sensor determines when the cam 228 operated by the actuator 240 has positioned the wiper 408 within the cleaning fluid in the container 404. The operation of the actuator 240 is then stopped until the wiper 408 needs to be moved into position for cleaning a printhead face. The sensor 604 can be an optical sensor or other suitable type of sensor capable of detecting the notch 612 in the wheel 608.

Figure 7:
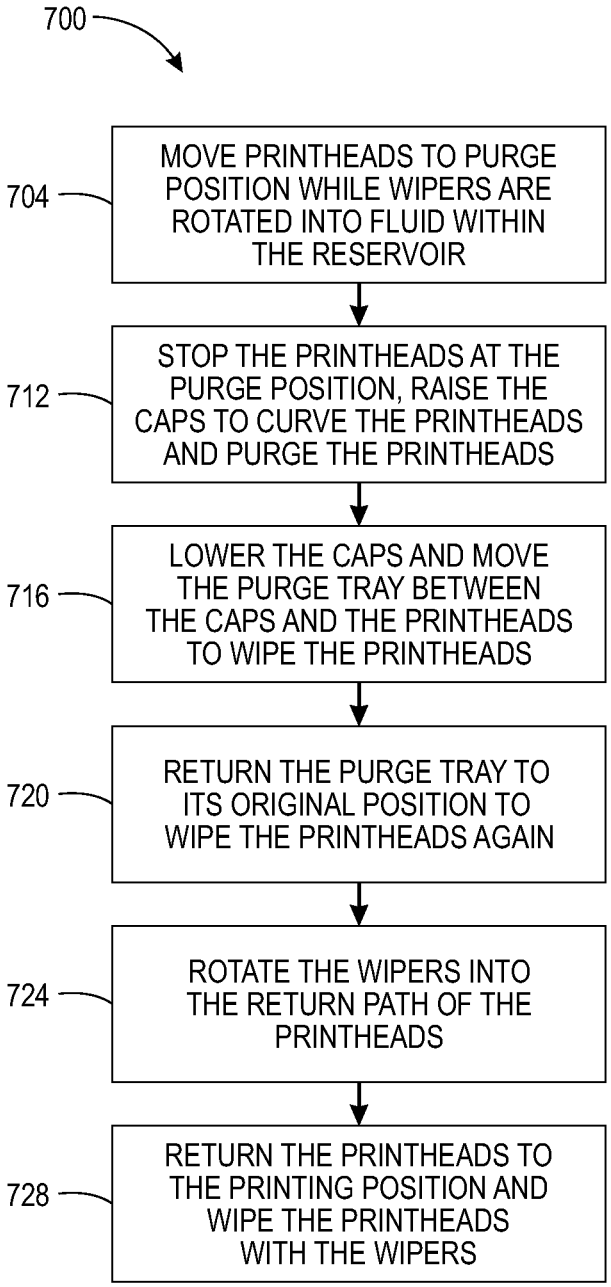
FIG. 7 is a flow diagram of a process for using the system of FIG. 1 to purge and clean printheads.

FIG. 7 depicts a process 700 for operating the printer 5 to purge the printheads and clean purged ink from the faces of the printheads. The process 700 is described in conjunction with the printer 5 of FIG. 1 for illustrative purposes. While process 700 is described with reference to the continuous media printer 5, other printing devices, including cut-sheet media printers can be configured to operate and perform the process 700. The process 700 refers to a controller, such as the controller 428 described above, executing programmed instructions stored in a memory operatively connected to the controller to cause the controller to operate one or more components of the printer to perform the specified function or action described in the process.

In the process 700, a purge operation begins with the controller 428 operating the actuator 206 to move the printhead assembly past the wiper assembly 208 while the controller 428 operates the actuators 240 to rotate the cams to position the wipers within the cleaning fluid reservoir (block 704). The controller 428 stops the printhead assembly 204 when it is opposite the sealing cap assembly 212. After the controller 428 operates the actuator 218 to raise the caps 220 to seal the printhead faces, the ink is purged from the printheads (block 712). The controller 428 then operates the actuator 218 to lower the sealing caps and the controller operates actuator

260 to move the purge tray to the position between the sealing cap assembly 212 and the printhead assembly 204 (block 716). As the purge tray moves to the position opposite the printhead assembly, the wiper 244 removes a substantial portion of the purged ink remaining on the printhead faces. The controller 428 operates the actuator 260 to return the purge tray to its original position and during this retraction, the wiper 244 again removes ink from the printhead faces (block 720). Once the tray 216 returns to its original position, the controller 428 operates the actuators 240 to rotate the cams 228 so the wipers are positioned in the return path of the printheads to the printing position (block 724). As the controller 428 operates the actuator 206 to return the printhead assembly 204 to the printing position, the printhead assembly moves past the wipers on the cams 228 and the wipers contact the faces of the printheads (block 728). The wiping action coupled with the cleaning fluid on the wipers removes the remaining purged ink from the printhead faces. When the printhead assembly reaches the printing position from which it started, the controller 428 stops the printhead assembly 204 and the purging operation is completed. The printhead assembly is now ready for printing.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printer comprising:

a plurality of printheads arranged to eject ink across a width of an image receiving surface in a cross-process direction as the image receiving surface passes the plurality of printheads in a process direction, the plurality of printheads being operatively connected to an actuator and the actuator being configured to move the plurality of printheads in the cross-process direction past the image receiving surface;

a wiper module having a reservoir configured to hold a cleaning fluid, at least one wiper, and at least one actuator operatively connected to the at least one wiper, the at least one wiper being configured to rotate the at least one wiper into the cleaning fluid held within the reservoir and into a position in which the at least one wiper can contact the plurality of printheads after the plurality of printheads has past the image receiving surface;

a plurality of caps, each cap being configured to align with a printhead in the plurality of printheads when the plurality of printheads is positioned opposite the plurality of caps, each cap being operatively connected to an actuator to enable each cap to be moved to cover a face of the printhead aligned with the cap to enable the printhead covered by each cap to be purged and to enable each cap to be retracted from the printhead covered by each cap;

a receptacle having a volume and a wiper positioned across a width of the receptacle, the receptacle being operatively connected to an actuator to enable the receptacle to be moved in a direction opposite the process direction to move the wiper across the plurality of printheads when the plurality of printheads is positioned opposite the plurality of caps, the wiper being positioned to enable the wiper to remove a portion of ink purged from each printhead in the plurality of printheads that has been purged without contacting the face of each printhead; and a controller operatively connected to the actuator that is operatively connected to the plurality of printheads, the actuator that is operatively connected to the receptacle, the actuator that is operatively connected to the plurality of caps, and the at least one actuator that is operatively connected to the at least one wiper, the controller being configured to:

operate the actuator operatively connected to the plurality of printheads to move the plurality of printheads from a position opposite the image receiving surface to the position opposite the plurality of caps;

operate the actuator operatively connected to the plurality of caps to move the caps in the plurality of caps to cover the face of each printhead in the plurality of printheads and to move the caps in the plurality of caps away from the face of each printhead in the plurality of printheads in response to the printheads in the plurality of printheads being purged;

operate the actuator operatively connected to the receptacle to move the receptacle between plurality of caps and the plurality of printheads to remove the portion of the ink purged from the plurality of printheads and enable the removed portion of the ink to fall within the receptacle;

operate the actuator operatively connected to the at least one wiper to move the wiper from the position within the reservoir to a position that enables the at least one wiper to contact the printheads in the plurality of printheads; and operate the actuator operatively connected to the plurality of printheads to move the plurality of printheads past the wiper module to enable the at least one wiper to contact the faces of the printheads in the plurality of printheads as the plurality of printheads moves past the wiper module to remove ink from the faces of the printheads in the plurality of printheads and to return the plurality of printheads to a position opposite the image receiving surface.

2. The printer of claim 1, the receptacle further comprising:

a floor having an opening, the floor being oriented at an angle to a plane parallel with an opening to the receptacle to enable ink removed from the printheads to move under an effect of gravity to the opening in the floor and exit the receptacle.

3. The printer of claim 1, the reservoir of the wiper module further comprising:

a floor having an opening, the floor being oriented at an angle to a plane parallel with an opening to the reservoir to enable ink removed from the faces of the printheads to move under an effect of gravity to the opening in the floor and exit the reservoir.

4. The printer of claim 1, the at least one wiper of the wiper module further comprising:

a plurality of wipers, each wiper having a width that enables the wiper to wipe the face of the printhead being contacted by one of the wipers in the plurality of wipers.

5. The printer of claim 4, the at least one actuator operatively connected to the plurality of wipers further comprising:

a plurality of actuators, each actuator in the plurality of actuators having a rotating member extending from the actuator; and each rotating member of each actuator being operatively connected to one wiper in the plurality of wipers in a one-to-one correspondence.

6. The printer of claim 5, each wiper in the plurality of wipers further comprising:

a pair of wipers extending from the rotating member of the actuator to which the pair of wipers is operatively connected.

7. The printer of claim 6, each pair of wipers in the plurality of wipers further comprising:

a stiffener positioned between the wipers in each pair of wipers.

8. The printer of claim 3, the wiper module further comprising:

a source of fluid, the source being fluidly connected to the reservoir of the wiper module;

a pump operatively connected between the source of fluid and the reservoir of the wiper module; and the controller being operatively connected to the pump, the controller being further configured to operate the pump to move fluid from the source into the reservoir of the wiper module.

9. The printer of claim 8, the wiper module further comprising:

a fluid level sensor configured to generate a signal indicating a fluid level in the reservoir is at a first position; and the controller is operatively connected to the fluid level sensor to receive the signal generated by the fluid level sensor, the controller being further configured to operate the pump to move fluid from the source into the reservoir of the wiper module in response to the controller receiving the signal indicating the fluid level in the reservoir is at the first position.

10. The printer of claim 9, the wiper module further comprising:

a receptacle fluidly connected to the opening in the floor of the reservoir of the wiper module;

another pump operatively connected between the receptacle and the opening in the floor of the reservoir of the wiper module;

the fluid level sensor being further configured to generate another signal indicating the fluid level in the reservoir is at a second position; and the controller being operatively connected to the other pump, the controller being further configured to operate the other pump to move fluid from the reservoir into the receptacle in response to the controller receiving the signal indicating the fluid level in the reservoir is at the second position.

11. A method of operating a printer comprising:

operating with a controller an actuator operatively connected to a plurality of printheads to move the plurality of printheads from a position opposite an image receiving surface to a position opposite a plurality of caps;

operating with the controller an actuator operatively connected to the plurality of caps to move the caps in the plurality of caps to cover the face of each printhead in the plurality of printheads and to move the caps in the plurality of caps away from the face of each printhead in the plurality of printheads in response to the printheads in the plurality of printheads being purged;

operating with the controller an actuator operatively connected to a receptacle to move the receptacle between the plurality of caps and the plurality of printheads to remove a portion of the ink purged from the plurality of printheads and enable the removed portion of the ink to fall within the receptacle;

operating with the controller an actuator operatively connected to at least one wiper to move the at least one wiper from a position within a reservoir to a position that enables the at least one wiper to contact the printheads in the plurality of printheads; and operating with the controller an actuator operatively connected to the plurality of printheads to move the plurality of printheads past the at least one wiper to enable the at least one wiper to contact the faces of the printheads in the plurality of printheads as the plurality of printheads moves past the at least one wiper to remove ink from the faces of the printheads in the plurality of printheads and to return the plurality of printheads to a position opposite the image receiving surface.

12. The method of claim 11, the rotation of the at least one wiper further comprising:

operating with the controller each actuator in a plurality of actuators having a rotating member extending from the actuator and each rotating member being operatively connected to one wiper in a plurality of wipers in a one-to-one correspondence.

13. The method of claim 11 further comprising:

the controller being operatively connected to the pump, the controller being further configured to operating with the controller a pump to move fluid from a source of fluid into the reservoir in which the wipers are rotated.

14. The method of claim 11, the wiper module further comprising:

generating with a fluid level sensor a signal indicating a fluid level in the reservoir is at a first position in response to the fluid level sensor detecting the fluid level in the reservoir being at the first position; and operating with the controller the pump to move fluid from the source of fluid into the reservoir in response to the controller receiving the signal indicating the fluid level in the reservoir is at the first position.

15. The method of claim 14 further comprising:

generating with the fluid level sensor a signal indicating a fluid level in the reservoir is at a second position in response to the fluid level sensor detecting the fluid level in the reservoir being at the second position; and operating with the controller the pump to move fluid from the reservoir to a receptacle in response to the controller receiving the signal indicating the fluid level in the reservoir is at the second position.

* * * * *